US006120092A

United States Patent [19]

Asad

[11] Patent Number: 6,120,092

[45] Date of Patent: Sep. 19, 2000

[54] HOLDER FOR PACIFIERS

[76] Inventor: Susan S. Asad, 7644 Golden Hill Ct., Clarkston, Mich. 48348

[21] Appl. No.: 09/104,943

[22] Filed: Jun. 25, 1998

Related U.S. Application Data

[60] Provisional application No. 60/050,754, Jun. 25, 1997.

[51] Int. Cl.[7] ..... A47C 7/62

[52] U.S. Cl. ..... 297/188.2; 297/188.18; 5/503.1

[58] Field of Search ..... 297/188.2, 7, 188.01, 297/188.06, 188.18; 224/275; 206/524.2; 5/93.1, 100, 503.1, 658, 662

[56] References Cited

U.S. PATENT DOCUMENTS 2,061,302 11/1936 Egler ..... 297/188.18
2,606,593 8/1952 Bearskens ..... 297/188.2 X
4,339,061 7/1982 Dunn ..... 297/188.18 X
5,699,564 12/1997 Heh ..... 5/503.1

*Primary Examiner*—Laurie K. Cranmer
*Attorney, Agent, or Firm*—Weintraub & Brady, P.C.

[57] ABSTRACT

A holder for infant accessories such as pacifiers or the like is defined by a substantially cylindrical side wall and a circular bottom wall which are secured together by any suitable method, such as sewing or the like. The side wall and the bottom wall are formed from a soft pliant material, such as a natural fiber and may be defined by an outer layer of pliant material an intermediate layer of cushioning material and an inner layer of plaint material. Suitable belting sections are secured to the side wall to enable the holder to be removably attached to a slat of a crib or other infant seating device. The device enables the stowage and easy accessibility to infant accessories by both the infant and a caregiver.

3 Claims, 1 Drawing Sheet

FIG 1
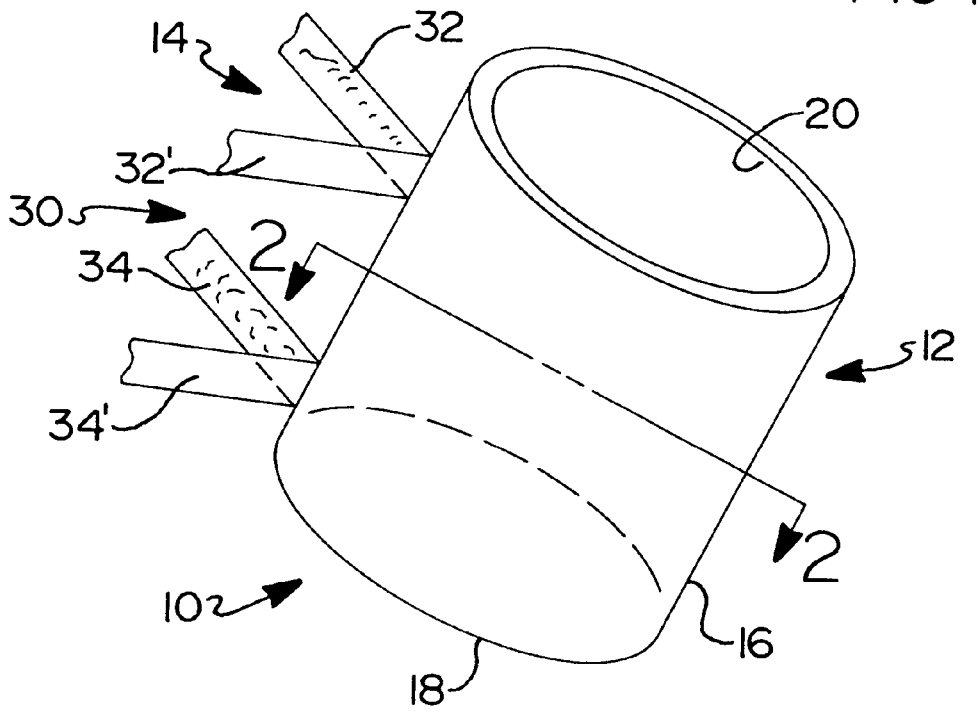
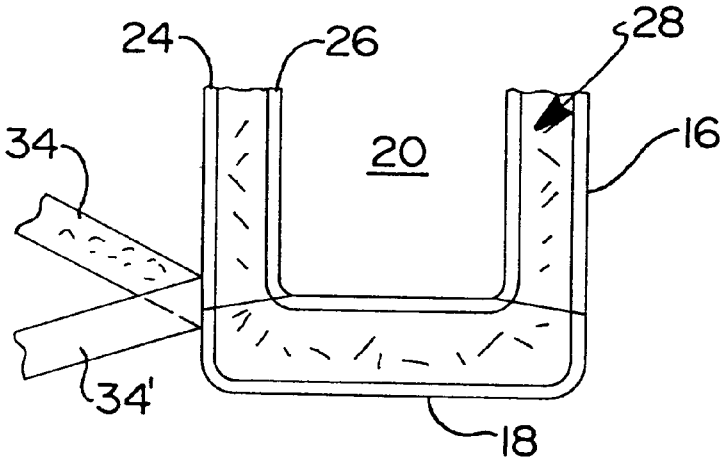
FIG 2

HOLDER FOR PACIFIERS

CROSS REFERENCE TO RELATED APPLICATIONS

This application is a completion application of U.S. provisional application Ser. No. 60/050,754 filed Jun. 25, 1997 for "Holder For Pacifiers", the disclosure of which is hereby incorporated by reference.

STATEMENT REGARDING FEDERALLY SPONSORED RESEARCH

Not applicable.

BACKGROUND OF THE INVENTION

1. Field of the Invention

The present invention pertains to accessories for infants. More particularly, the present invention concerns holders for pacifiers. Even more particularly, the present invention concerns such holders which are easily and safety stowed within a crib.

2. Prior Art

As is known to those skilled in the art to which the present invention pertains pacifiers are one of the major implements which are used in infant care to comfort and relieve distress in the infant. At times, especially with older infants, the care giver is not, at all times, accessible to the infant. Yet, the demand for the pacifier can arise at any given moment. Absent a convenient and readily accessible place for a pacifier, a child will ordinarily begin to cry or, otherwise, indicate its need for attention. Thus, to alleviate the situation there exists a need for a pacifier holder or similar device that is easily accessible and usable by an infant. Yet, it is necessary that for such a device to be practical and implementable it is necessary that it be "infant safe" in that it can not create any danger to the infant.

As detailed hereinbelow, the present invention achieves this purpose.

SUMMARY OF THE INVENTION

In accordance with the present invention there is provided a holder for pacifiers and similar infant accessories for use in conjunction with an infant crib or other seating device and which, generally, comprises:

(a) an open topped body having a side wall and a bottom wall, the side wall and bottom wall cooperating to define a holding member having an open interior chamber, and (b) means for removably attaching the holder to the seating device.

Infant seating devices, such as an infant's crib usually includes a headboard, footboard and slatted, vertically movable side walls. The means for removably attaching is, preferably, secured to one of the slats of the crib for easy accessibility and removability. Similarly, the device can be secured to a child safety seat, bassinet, high chair, etc.

The device hereof is made from a soft, non-toxic, substantially smooth material, natural or synthetic, such as cotton, sponge, or the like so that the device cannot injure or maim an infant. Furthermore, the device is dimensioned so that a plurality of pacifiers or similar infant accessories can be stored therewithin for easy accessibility.

The means for removably attaching is fixably secured to the body portion and may comprise any suitable means, such as lace, strips of hook and loop fasteners, belting such as cloth strips which can be tied around a slat of a crib, or around a bassinet handle, safety of a car seat, etc.

Further, the device may be made from or include a source of luminescence or light reflective to render it night-time visible.

For a more complete understanding of the present invention reference is made to the following detailed description and accompanying drawing. In the drawing like reference characters refer to like parts throughout the several views in which:

BRIEF DESCRIPTION OF THE DRAWING

FIG. 1 is a perspective view of a holder for a pacifier in accordance with the present invention, and FIG. 2 is a cross-sectional view taken along line 2—2 of FIG. 1.

DESCRIPTION OF THE PREFERRED EMBODIMENT

As hereinabove noted, the present invention provides a container or holder for a pacifier which can be safely stowed within the interior of a crib or otherwise secured to an infant seating device and which is used in conjunction therewith. As detailed hereinbelow, the present invention, generally, comprises:

(a) an opened topped body having a side wall and a bottom wall, the side wall and bottom wall cooperating to define a holding member having an open interior chamber, and (b) means for removably attaching the holder to the seating device.

Thus, and with more particularity and with reference to the drawings, there is depicted therein a holder or container for a pacifier(s) in accordance with the present invention and which is, generally, denoted at 10. The device 10 includes a holding member or body 12 and means, generally, denoted at 14, for removably securing the container to the crib about a slat thereof (not shown).

As shown, the preferred configuration for the holder is cylindrical. However, it is to be understood that other geometric configurations are within the scope hereof. For purposes of detailing the present invention, though, the cylindrical shape will be assumed. The body 12 includes a side wall 16 and a bottom wall 18. The side wall 16 is circumferentially disposed about the bottom wall and projects upwardly therefrom. The side wall 16 is integrally formed or otherwise secured to the bottom wall, such as by sewing, sonic welding or the like. The holder is open topped, as shown, to provide access into the interior 20 thereof. Thus, it is to be appreciated that the side wall and the bottom wall cooperate to define an open topped holding member with an open interior or chamber.

The holder 10 hereof has a diameter which is sufficiently large to removably stow therewithin at least one pacifier (not shown) and, preferably, a plurality thereof within the confines defined by the interior chamber. In order to render the present device safe for usage by an infant the holder, itself, is formed from a soft, pliant material, such as cotton, woven polyester or the like. Preferably, and as shown in the drawing, the side wall, preferably, the bottom wall, as well comprises first and second spaced apart layers 24 and 26 formed from any soft fabric, as denoted above. Additionally, a cushioning member 28, such as a cotton fiber or sponge material, such as polyurethane sponge, or the like is disposed between the layers to provide a cushioning effect. The bottom wall 18 is, preferably, similarly constructed.

Furthermore, the holder, per se, has no sharp edges which could injure the infant. The present invention, further, includes means 30 for removably attaching the container 10 to a crib (not shown). In this regard, optimally, the holder 10 hereof is intended to be secured in place at a corner of a crib.

As noted above, and as is known to those skilled in the art to which the present invention pertains a crib for an infant, generally, comprises a head board and a foot or base board with slatted side boards which are both, normally, vertically raisable and lowerable through a latching mechanism. It is to be understood that the construction of the crib, per se, is not critical hereto only that the present invention is intended to be used with a normal slotted crib construction. Thus, a pair of straps or beltings 32, 32', 34, and 34' associated with and secured to the body 12 are removably secured to the side wall about the exterior thereof to fix the device 10 in position during use.

The beltings 32, 32' and 34, 34' are secured to the body 12 by any suitable means, such as by sewing or the like. The belting enables the holder 10 to be tied around any convenient slat proximate the corner of a crib. The removable securement of the beltings 32 to 32' and 34 to 34' can be achieved, as noted, such as by tying the respective or associated two belting sections together.

Although not shown, alternate means of removable attachment may be employed such as through a snap arrangement; through a hook and loop fastener arrangement, such as that sold under the name VELCRO, disposed at least at the free terminii of each of the beltings which can then used to removably secure the associated two belting sections together, or any similar means. Again, the belting sections are formed from a soft, pliant material to prevent any injury to the infant.

In use, at least one, and preferably, a plurality of pacifiers are stowed within the interior chamber of the holding member and the holder, itself, is secured in a corner of the crib through the belting sections.

It should be further noted with respect hereto that although the device enables easy access for an infant to a pacifier, similarly, the device provides an easy access for the care giver. The present invention precludes the need to go searching for a pacifier in darkness or if during diapering or other ministration where ease of accessibility to a pacifier is highly desired.

In this regard, the exterior of the body may have a luminescence, including phosphorescence, or reflectance imparted thereto through either a reflective phosphorescent or similar material secured to or integrated into the material defining the exterior of the body.

Also, it is to be understood that other infant accessories may be stowed within the holder thereof. Similarly, the present device may be removably secured to a bassinet via its handles or to a child safety seat by securing it around the slat bar or likewise to other infant seating devices, such as a high chair, etc.

It is to be appreciated from the preceding that there has been described herein, a container for a pacifier or other infant implement which is not only safe to use but provides easy accessibility to the implement, itself.

Having thus described the invention what is claimed is:

1. A holder for an infant accessory for use in conjunction with an infant seating device, comprising:

(a) a unitary, integral open-topped body, the body having a side wall and a bottom wall, the side wall and bottom wall cooperating to define a holding member having an open interior chamber, the body comprising an outer layer of soft pliant material, an intermediate cushioning member and an inner layer of soft pliant material, the bottom wall and side wall being secured together, the body being without any sharp edges and (b) means for removably attaching the holder to the seating device, the means for removably attaching comprising comprising a pliant material, fixedly secured to the outer layer.

2. The holder of claim 1 wherein the seating device is a slatted crib and the means for removably attaching comprises a plurality of beltings secured to the body, each belting comprising first and second belting sections which cooperate to secure the body to a slat of a crib.

3. The holder of claim 1 which further comprises:

a luminescent material secured to the outer layer.

* * * * *